US006712076B2

(12) United States Patent
Alexander et al.

(10) Patent No.: US 6,712,076 B2
(45) Date of Patent: Mar. 30, 2004

(54) SHADE-EVIDENT AIRTIGHT CONTAINER

(75) Inventors: Jon Alexander, Stoughton, WI (US); Keith S. Everson, Hartford, WI (US); Carol J. Nikolaus, Shorewood, WI (US)

(73) Assignee: Rexam Beauty and Closures Inc., Sussex, WI (US)

( * ) Notice: Subject to any disclaimer, the term of this patent is extended or adjusted under 35 U.S.C. 154(b) by 0 days.

(21) Appl. No.: 10/096,352

(22) Filed: Mar. 12, 2002

(65) Prior Publication Data

US 2003/0172949 A1 Sep. 18, 2003

(51) Int. Cl.[7] ..... A45D 33/24
(52) U.S. Cl. ..... 132/300; 132/303
(58) Field of Search ..... 132/293, 294, 132/295, 300, 303; 206/581, 235, 776, 777, 782

(56) References Cited

U.S. PATENT DOCUMENTS

| | | | | | |
|---|---|---|---|---|---|
| 1,710,661 | A | | 4/1929 | Hines | |
| 2,035,832 | A | | 3/1936 | Parkin | |
| 2,148,077 | A | | 2/1939 | Lampl | |
| 2,479,854 | A | | 8/1949 | Miller | |
| 3,117,691 | A | | 1/1964 | Williams | |
| 3,911,936 | A | * | 10/1975 | Kingsford | 132/295 |
| 4,347,943 | A | | 9/1982 | Hackwell et al. | |
| 4,471,880 | A | | 9/1984 | Taylor et al. | |
| 4,569,438 | A | * | 2/1986 | Sheffler | 132/295 |
| 4,586,519 | A | | 5/1986 | Seidler et al. | |
| 4,681,127 | A | * | 7/1987 | Gueret | 132/295 |
| 4,708,259 | A | | 11/1987 | Olimpio | |
| 4,801,039 | A | | 1/1989 | McCall et al. | |
| 4,826,014 | A | * | 5/1989 | Schefer | 206/581 |
| 5,205,431 | A | | 4/1993 | Zinnbauer | |
| D338,086 | S | | 8/1993 | Roberts | |
| 5,425,469 | A | | 6/1995 | Freedland | |
| 5,431,177 | A | | 7/1995 | Kecman | |
| D368,987 | S | | 4/1996 | Boucheron | |
| 5,531,349 | A | | 7/1996 | Wojcik et al. | |
| 5,669,400 | A | | 9/1997 | Sheffler et al. | |
| 5,769,234 | A | * | 6/1998 | Gueret | 206/581 |
| 5,842,486 | A | | 12/1998 | Davis et al. | |
| 5,875,918 | A | | 3/1999 | Sheffler et al. | |
| 5,884,636 | A | | 3/1999 | Sheffler et al. | |
| D408,590 | S | | 4/1999 | Litton | |
| 5,906,212 | A | | 5/1999 | Favre | |
| 5,931,169 | A | * | 8/1999 | Kervoalen | 132/294 |
| 5,950,638 | A | * | 9/1999 | Crosta | 132/293 |
| D424,751 | S | | 5/2000 | Kudo et al. | |
| 6,102,209 | A | * | 8/2000 | D'Andrea | 206/581 |
| 6,173,719 | B1 | | 1/2001 | Petit | |
| 6,199,559 | B1 | | 3/2001 | Nikolaus et al. | |
| 6,298,863 | B1 | * | 10/2001 | Byun | 132/294 |
| 6,311,701 | B1 | | 11/2001 | Yuhara et al. | |
| 6,336,460 | B2 | | 1/2002 | Yuhara | |

FOREIGN PATENT DOCUMENTS

| | | |
|---|---|---|
| CH | 380299 | 11/1959 |
| EP | 0 919 156 | 7/1998 |
| FR | 2576496 | 1/1986 |
| GB | 599452 | 9/1946 |
| WO | WO 83/02051 | 12/1982 |
| WO | WO 98/36985 | 2/1998 |

* cited by examiner

*Primary Examiner*—Todd E. Manahan
(74) *Attorney, Agent, or Firm*—Foley & Lardner

(57) ABSTRACT

A container for storing makeup is disclosed. The container may include a cover and a base coupled to the cover and configured for holding cosmetic material. The container may be selectively reconfigurable between a open, use position and a closed, storage position and the cover may engage the base to provide a hermetic seal when the container is in the storage position. The cosmetic material may be viewed in the substantially airtight container through at least one viewing area.

28 Claims, 7 Drawing Sheets

SHADE-EVIDENT AIRTIGHT CONTAINER

BACKGROUND

Field of the Invention

The present invention relates to a container system. The present invention also relates to a make-up case or a cosmetic compact. More particularly, the present invention relates to an airtight or hermetically sealed cosmetic compact case with at least one viewing area.

Conventional compact cases hold makeup or cosmetics, such as, powders, eye shadow, eyeliner, lipstick, or other beauty aids. Compacts often provide a mirror and an applicator for facilitating the application of makeup to the face.

A compact usually includes a lid or a cover section hingeably coupled to a base or a container section. Either the cover section or the base section can be pivoted about a hinge to obtain a closed-position of the compact, thereby providing a convenient storage device. The mirror is typically disposed on the inside of the compact cover section. The base section of conventional compacts usually includes a cavity, which may be configured to receive a metal pan that contains or holds the makeup. Alternatively, the makeup can be directly stored in the cavity in the base section.

Compacts also allow for an applicator, including a pad, a brush, or other similar device. Generally, the applicator is disposed between the base and the cover when the compact is in the closed-position. Makeup is usually applied by rubbing or dipping the applicator (e.g., the pad or brush) in the pan or cavity holding the makeup. The applicator is then used to transfer and apply the makeup to the face.

Conventional compacts are enclosed in packages to prevent product tampering and displayed in stores on shelves or other display areas. Compact sellers attempt to display as many compacts as possible in a display area, which is a valuable commercial resource. Therefore, compact sellers desire to maximize the number of compacts per display area. However, conventional compacts do not permit viewing the cosmetic material contained therein when in the package. Compact sellers are thus required to provide a sampling area, which eliminates valuable display area for selling compacts. Thus, compact sellers desire to minimize any packaging or sampling areas that fill commercial space so as to maximize the number of packages which can be seen by the buyers.

In order to appropriately display a compact, the makeup within the container section must be readily visible to the buyer. Color and/or texture of the makeup is generally extremely important to the buyer of makeup. In order to display the cosmetic in the compact, traditional compact sellers package the compact in a generally open position, showing both the lid section and the container section in a single plane (on the front side of the package). Showing both the lid section and container section in a single plane doubles the amount of display area required to appropriately show the compact. Other display methods include providing a sample area that includes samples of all different shades, colors and textures of the cosmetics provided by the manufacturer. Again, these display items waste valuable commercial selling space.

Additionally, many currently available cosmetics contain a volatile chemical component that may require substantially airtight or hermetic storage to prevent or inhibit drying, hardening, and cracking of the cosmetics. An example of such a product are color-fast cosmetics that allows the cosmetics to remain applied to the skin surface for a prolonged period without rubbing off or fading.

Conventional compacts are usually arranged as a one-piece unit so that one hand of a user opens and holds the compact, while the other hand of the user applies the makeup to the skin surface of the face. However, many conventional one piece units do not provide an airtight seal. Other cases for containing more volatile cosmetics have thus been used, including containers with a screw-on cap. These containers effect a hermetic seal when in the closed-position. However, the user must contend with two separate pieces, which makes applying the makeup a more difficult task, i.e., it is more difficult for the user to unscrew the cap and apply the makeup at the same time.

Accordingly, it would be advantageous to provide an inexpensive and simple-to-use compact case which allows the buyer to view the color, shade and/or texture of the cosmetic when the container is in a closed position. It would also be advantageous to provide a container that is capable of effecting a substantially airtight or hermetic seal when in the closed position. Such a container should desirably be a one-piece container It would also be advantageous to provide a container which allows the shade of the cosmetic stored therein to be viewed when the container is in the closed position. Also, it would be advantageous to provide a conventional style container (e.g., with a mirror and applicator), with product integrity from an airtight sealing mechanism and with shade-evidence, which would allow consumers to make an educated purchase and allow a retailer to increase commercial selling space.

It would be desirable to provide a system having any one or more of these or other advantageous features.

SUMMARY OF THE INVENTION

To overcome the problems and disadvantages described above, a container for holding cosmetics and having a cover and a base is provided. The cover may be coupled to the base to permit pivoting the cover from a closed, storage position to an opened, use position relative to the base. The coupling mechanism may be a hinge with a spring, a living hinge, or other types of coupling mechanisms known to those skilled in the art. The base is also configured to retain the cosmetic material so that the cosmetic material may be accessed when the container is in the open-position.

The cover is configured to engage the base to provide an airtight or substantially airtight seal when the container is in the closed position. To effect the airtight seal, the cover may have a first interface, the first interface having a first periphery. Likewise, the base may have a second interface, the second interface having a second periphery corresponding to the first periphery. When the container is placed in the closed-position, the first interface engages the second interface to prevent air flow into and out of the container. The container may also include a discharge for reducing the air pressure integral with the first or the second interface.

The container also includes at least one viewing area, which permits the cosmetic material retained within the container to be viewed when the container is in the closed-position. The viewing area may be a transparent cover or base. Alternatively, the viewing area may be formed by molding a transparent segment within the cover, base or both, in a position to permit the cosmetic material to be viewed when the container is in the closed-position. The viewing area may also be provided by an aperture through the cover, base or both.

Also provided is a container for storing cosmetic material including a cover and a base pivotally coupled to the cover to selectively position the container in either an open-position or closed-position. The cosmetic material is retained by at least one pan. The base is configured for holding the pan, which can be secured to the base through adhesives, frictional engagement, a latching mechanism, or any other method of retaining a piece of material to another. The cover and base are configured to engage one another to provide a substantially airtight seal when the container is in the closed-position. At least a portion of the base, pan cover, or any combination of the same includes at least one viewing area which permits the cosmetic material to be viewed when the container is in closed-position.

Also provided is a container for storing a cosmetic material comprising a shell having a cover and a base pivotally coupled to the cover to selectively position the shell in an open-position or a closed-position. The container also includes an insert configured to retain cosmetic material and provide a substantially airtight seal when the shell is in the closed-position.

The insert may be a cup-lid combination that may be integral with the base. Desirably, the cup is configured to retain the cosmetic material and the lid may be pivotally coupled to the base or cup so that it may be selectively positioned to engage the cup in either a sealed position or an unsealed position. In the sealed position, the lid and cup provide the airtight or substantially airtight seal and maintain the cosmetic material in the airtight compartment between the lid and cup. Alternatively, the insert may include a cover piece and base piece pivotally coupled to the cover piece, where the cover piece and base piece fit within the cover and base of the shell, respectively. The base piece may then be configured to retain the cosmetic material.

The cosmetic material may be viewed when the shell is in the closed-position through at least one viewing area. The shell may include a plurality of viewing areas for viewing more than one cosmetic within the container. Because the cosmetic material is retained within the insert, the insert should also include a transparent portion which is disposed over or is proximate to the viewing area. For example, if a lid-cup combination is used, the lid, cup or both may be transparent. Additionally, the cosmetic material may be packaged in a pan, which is then positioned within the insert during manufacture. The pan should also include a transparent portion which is disposed over or proximate to the viewing area so as not obstruct view of the cosmetic material.

FIGURES

DETAILED DESCRIPTION OF EXEMPLARY EMBODIMENTS

With reference to all FIGURES, a container 10 is shown. Container 10 may be a cosmetic compact case for holding a cosmetic material 50 (e.g., pressed or loose powder, eye shadow, lipstick, eyeliner, creams, or other beauty aids). In particular, container 10 is preferably a cosmetic case with an airtight or substantially airtight seal for containing a color-fast cosmetic, e.g., a non-fading and rub-resistant, makeup.

Figure 1:
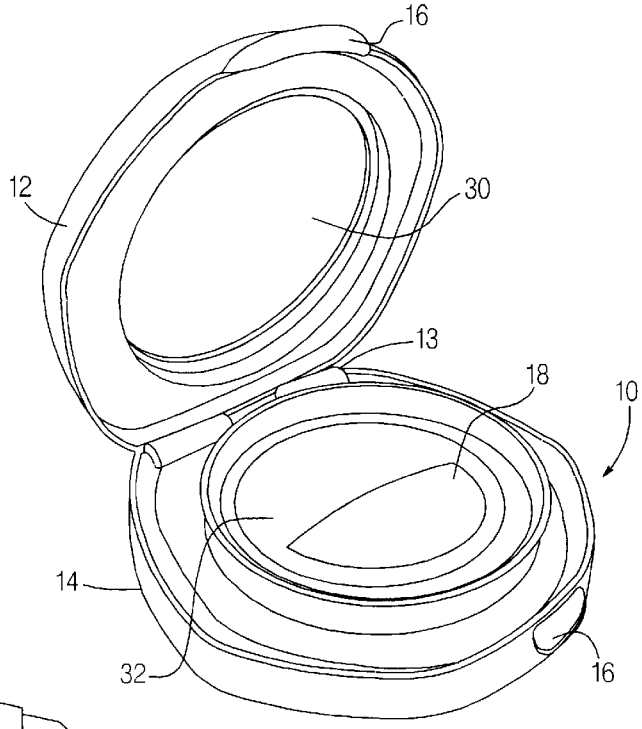
FIG. 1 is a perspective view of a container in an open-position in accordance with the teachings of the present invention.

Referring to FIG. 1, container 10 is shown in an open-position. Container 10 includes a cover 12 coupled to a platform or base 14 by a hinge assembly 13. Container 10 may be configured so that cover 12 includes a cavity 30, and base 14 includes a cavity 32. Cavity 30 and other features of cover 12 may provide a first sealing interface, while also providing a place for a display or mirror 96. Cavity 32 of base 14 with other features discussed below provide a second sealing interface, while also providing a place for storing and retaining cosmetic material. The hinge assembly 13 preferably limits rotation of cover 12 to 180 degrees. Activation of a user interface 16 releases a lock or seal and permits cover 12 to pivot from storage or closed-position (see FIG. 2) to the use or open-position for presentation or viewing of a display or mirror 96 and for access to contents contained therein.

Figure 2:
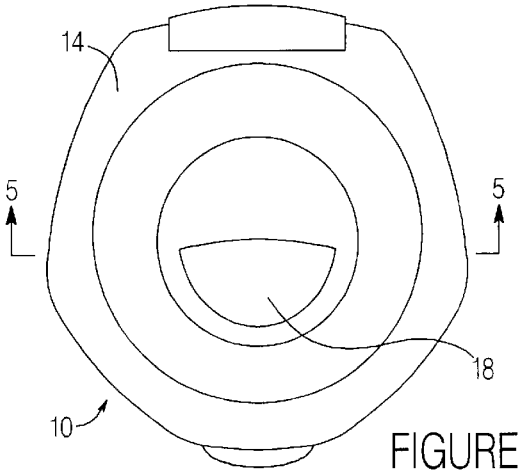
FIG. 2 is a plan view of the container of FIG. 1 shown in a closed-position and illustrating a viewing area.

FIG. 2 shows container 10 in the closed-position. Container 10 also includes a viewing area 18 which allows a user to view the cosmetic material 50 retained in cavity 32. The viewing area 18 may be located on either the cover 12, the base 14 or both, depending on arrangement of cosmetic material 50 within the container 10 or consumer preference.

Figure 4:
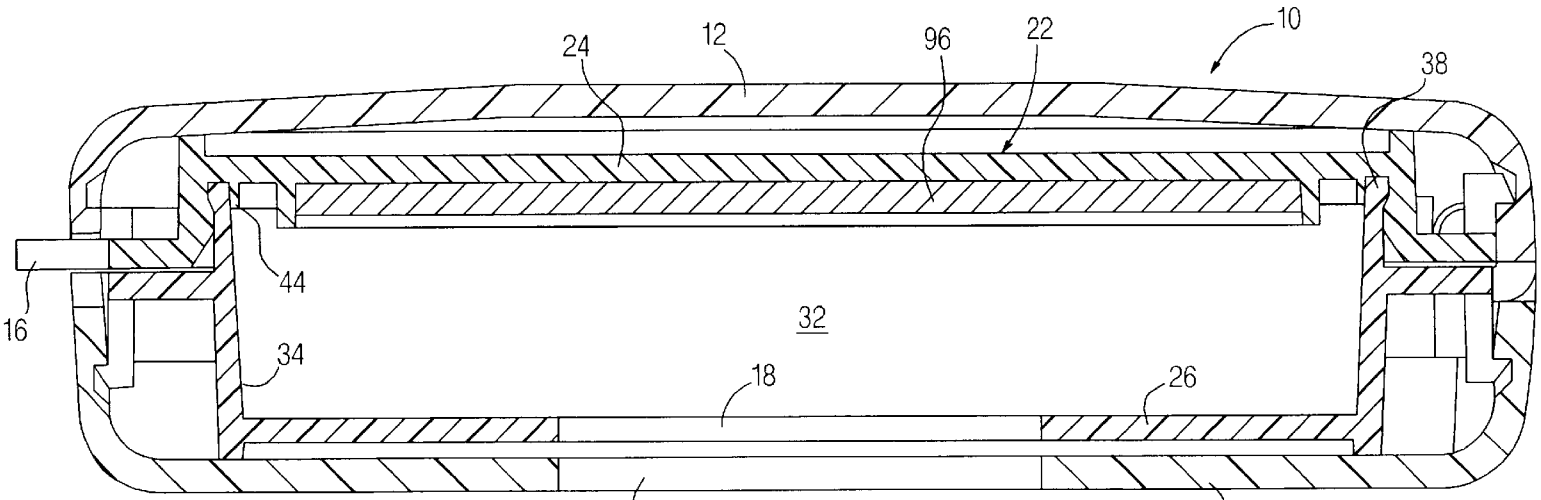
FIG. 4 is a cross-sectional view of a container similar to the container shown in FIG. 2, with the insert shown in FIG. 3 provided therein.
Figure 3:
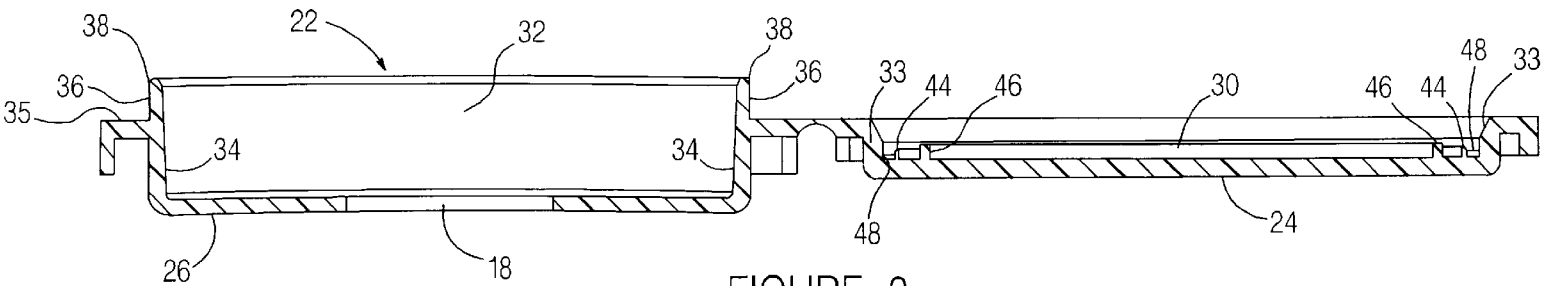
FIG. 3 is a cross-sectional view of an insert for use with a container in accordance with the teachings of the present invention.

Alternatively, container 10 may include a unitary or integral two-piece insert 22 as shown in FIGS. 3 and 4. Insert 22 preferably includes a top or cover piece 24 integral with a bottom or base piece 26. More specifically, cover piece 24 of insert 22 may be pivotally coupled to base piece 26 via a living hinge or be of two separate pieces. Insert 22 may be shaped in accordance with container 10 and may be sized to fit within the combination of cover 12 and base 14. When insert 22 is utilized, cover 12 and base 14 serve as a shell and cover piece 24 then includes cavity 30 and, similarly, base piece 26 then has cavity 32. Shell will then have a first viewing area 18 aligned with a second viewing area of insert 22 for viewing the cosmetic material contained within the container 10 when in the closed-position. Other exemplary embodiments may include an insert that has a cover piece and a base piece which are not coupled, but instead separate pieces that are held within the cover and base of shell, respectively. The insert may be held in place through adhesives, frictional engagement, a latching mechanism, or other methods or retaining and fitting two separate pieces known to those skilled in the art.

Figure 9:
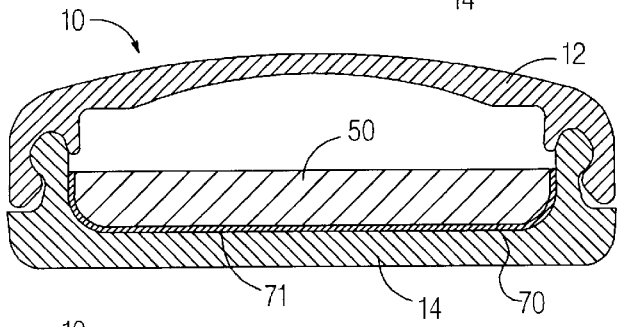
FIG. 9 is a cross-sectional view of an alternative embodiment of a container with a pan in accordance with the teachings of the present invention.

Cavity 32 is defined by a peripheral wall 34. A peripheral rim 36 may be integral with (e.g., continuous) with peripheral wall 34, circumferentially extending above a surface 35 of base piece 26, and melding into a terminal, outwardly protruding lip 38. Cavity 32 is preferably configured for retaining a cosmetic material 50. Other embodiments of container 10 may have a plurality of cavities for holding different materials. For example, container 10 may have one cavity for one shade of cosmetic material and another cavity for another shade of cosmetic material, or one cavity for cosmetic material and another cavity for an applicator (e.g., brush or pad). Alternatively, instead of cavity 32, base piece 26 can include an aperture configured such that a pan 70 pre-filled with cosmetic material can be disposed and retained therein (as shown in FIG. 9).

Cover piece 24 is also defined by a peripheral edge 33. A groove 48 may be circumferentially defined between peripheral edge 33 of cover piece 24 and a shorter peripheral wall 44. Groove 48 may be configured to receive peripheral rim 36 and lip 38 when container 10 is in a closed-position (e.g., when cover 12 engages base 14). Groove 48 of cover piece 24 thus provides a first sealing interface, and cavity 32 (along with peripheral rim 36 and lip 38) of base piece 26 provide a second sealing interface, which when engaged provide a substantially hermetic or airtight seal.

Figure 5:
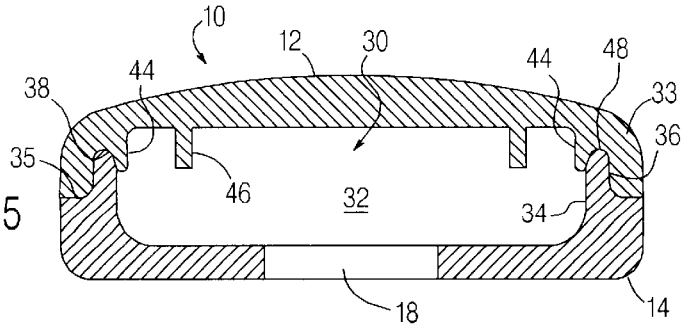
FIG. 5 is a cross-sectional view of the container shown in FIG. 2, without an insert therein.

A similar style of construction may be employed to effect a hermetic seal by a container 10 without insert 22 as shown in FIG. 5. Cover 12 may include a peripheral edge 33 and cavity 30. Cavity may include a peripheral wall 46 which can be used to locate a mirror. Groove 48 may be circumferentially defined between peripheral edge 33 and shorter peripheral wall 44. Similarly, FIG. 5 shows base 14 of container 10 also having a cavity 32, defined by a peripheral wall 34 which extends beyond the surface 35 of base 14 to define the peripheral rim 36. The peripheral rim melds into a terminal outwardly protruding lip 38. When cover 12 and base 14 are placed in the closed-position, groove 48 receives peripheral rim 36 and lip 38, thereby effecting the airtight or substantially airtight seal.

Figure 7:
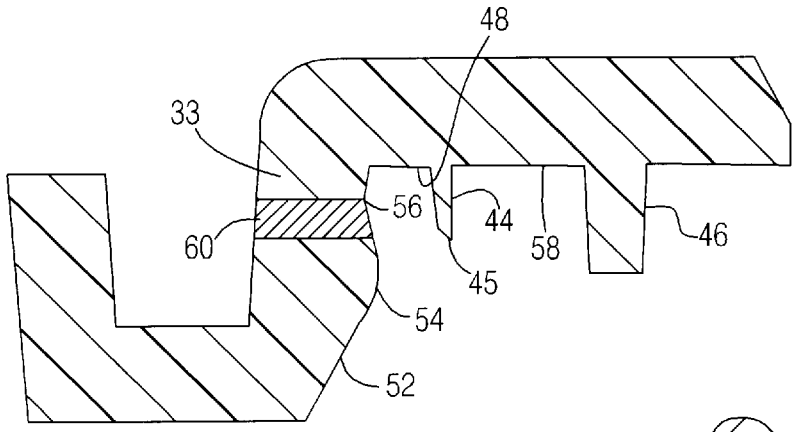
FIG. 7 is an enlarged cross-sectional view of a groove.
Figure 6:
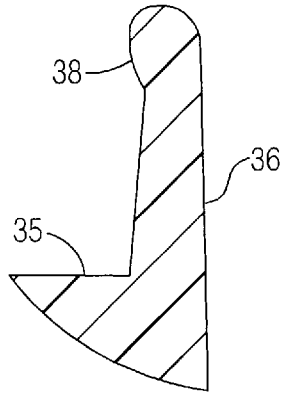
FIG. 6 is an enlarged cross-sectional view of a peripheral rim and a lip.

Both FIGS. 6 and 7 are enlarged, partial cross-sectional views of different aspects of the first sealing interface of cover 12 and the second sealing interface of base 14. More specifically, FIG. 6 shows an enlarged, partial cross-sectional view of lip 38 extending from peripheral rim 36. FIG. 7 is an enlarged, partial cross-sectional view showing groove 48 disposed between peripheral wall 44 and peripheral edge 33. FIG. 7 further shows that peripheral wall 44 terminates in a free end 45 and spans a height that may be shorter than a height of peripheral wall 46 of cavity 30. Peripheral edge 33 further includes a chamfer edge 52, a bulge 54 protruding in a direction toward groove 48, and an indentation 56 pointed in a direction away from wall 44. Another groove 58 may be disposed between shorter peripheral wall 44 and peripheral wall 46 of cavity 30.

To close container 10, an external downward force is supplied, such as, by hand, to cover 12 to effect a pivotal motion of cover 12 toward base 14. More specifically, as a result of the applied downward force on cover 12, hinge assembly 13 folds to close cover 12 onto base 14. In the process of closing container 10, groove 48 receives peripheral rim 36 and lip 38 between shorter peripheral wall 44 and peripheral edge 33, thereby effecting an airtight or substantially airtight seal at the interface. The seal can be formed between peripheral wall 34 and peripheral wall 44 or peripheral rim 36 and peripheral edge 33. Moreover, bulge 54 of peripheral edge 33 pushes peripheral rim 36 to bias peripheral rim 36 towards peripheral wall 44. Lip 38 of peripheral rim 36 also fits into indentation 56 of peripheral edge 33, thus securing the hermetic seal and maintaining container 10 in the closed-position. As container 10 obtains the closed-position, the evacuated air may make a distinctive audible sound, indicating that the hermetic seal has been established. The quality of the hermetic seal associated with container 10 is somewhat similar to seals utilized in photographic film containers or plastic food storage containers.

To open container 10, a pulling force is applied, such as, by hand, to cover 12 in a direction away from base 14. In the process of separating or disengaging cover 12 from base 14 from the closed-position of container 10, peripheral rim 36 may be removed from within groove 48, thereby disrupting, e.g., breaking, the hermetic seal formed at the interface between peripheral rim 36 and peripheral wall 44. As cover 12 is disengaged from base 14, another audible sound may be emitted, indicating the hermetic seal has been broken. The terms "airtight" and "hermetic", as used in this application, include an essentially non-leaking seal formed at atmospheric pressure, and may include either an airtight seal or a substantially airtight seal.

The container 10 may also include a discharge or valve (shown as a vent 60) for discharging or venting air from cavities 30 and 32 as shown in FIG. 7. Vent 60 may be generally square shaped and has a width. Vent 60 may be recessed in and integral with peripheral edge 33. Vent 60 provides for the discharge or venting of air from cavities 30 and 32 to the atmosphere. To discharge air from cavities 30 and 32, container 10 may be positioned from the open-position to fully closed-position. Such closing of container 10 permits air trapped within cavities 30 and 32 to be discharged to the atmosphere. Although vent 60 functions to permit gas or air to be discharged (i.e., escape) from the cavities during closing of container 10, it does not substantially degrade the generally hermetic seal when the container 10 is in the closed position. Thus, the contents (e.g., cosmetic material) in cavity 32 or pan 70 are not substantially degraded even though container 10 includes a vent.

Although the above-description sets forth the detailed construction of effecting an airtight or substantially airtight seal for the preferred embodiment of container 10, it would be apparent to one of ordinary skill in the art to provide alternative sealing mechanisms. A non-limiting example includes use of a compression seal to effect a hermetic seal. A ring may be placed around the periphery of cover and/or base, which prevents air flow into or out of the container when in the closed-position.

Figure 8:
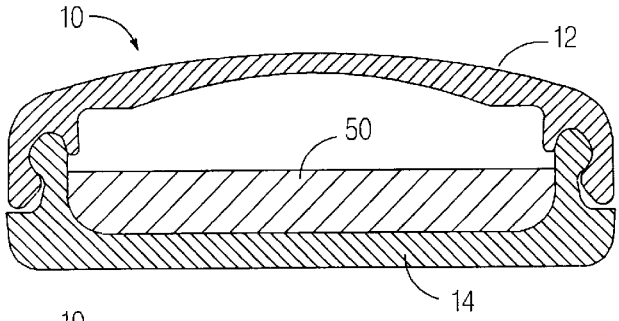
FIG. 8 is a cross-sectional view of an alternative embodiment of a viewing area for a container in accordance with the teachings of the present invention.

FIGS. 8–12 provide alternative embodiments of container 10 by a position and type of viewing area 18. All alternative embodiments show container 10 storing cosmetic material 50 within the airtight compartment provided by the hermetic seal described above and are not meant to provide an exhaustive summary of the different containers that are encompassed by the present invention. In FIG. 8, the viewing area is provided by a transparent cover 12, which allows the cosmetic material 50 contained within the container to be viewed when container 10 is in the closed-position. The base 14 may be either transparent or opaque. Alternatively, the viewing area may be a transparent base 14, with the cover 12 being either transparent of opaque.

FIG. 9 shows another embodiment of container 10, where cavity 32 is configured to retain pan 70 holding cosmetic material 50. In this embodiment, the viewing area may also be transparent cover 12 for viewing cosmetic material 50 when container 10 is in the closed-position. Again, the base 14 may be either transparent or opaque depending on desired specification requirements. Alternatively, container 10 may have a viewing area which is provided by a transparent base 14, with either a clear or opaque cover 12. When viewing area 18 is a transparent base 14, at least the bottom portion 71 of pan 70 should be transparent as well to permit viewing the cosmetic material 50. As will be apparent to one of ordinary skill in the art, the pan 70 can be used in place of storing cosmetic material directly inside a cavity of the base for all embodiments of the container.

Figure 10:
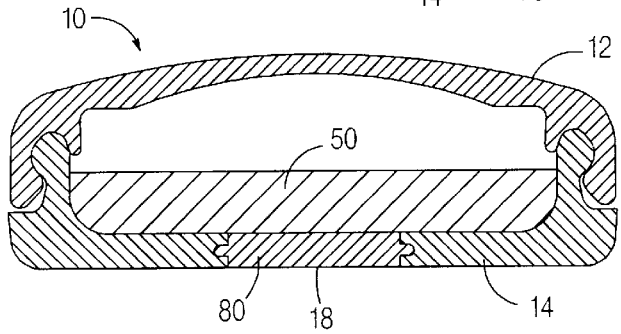
FIG. 10 is a cross-sectional view of an alternative embodiment of a viewing area for a container in accordance with the teachings of the present invention.

FIG. 10 shows an alternative embodiment to container 10, where viewing area 18 is provided by an over-molded transparent segment 80 positioned within base 14 of container 10. Generally, over-molded segment 80 is first cut or molded and then transferred into another mold where either clear or non-clear material is injected and/or formed around the over-molded segment 80. This process provides viewing area 18, which may be positioned over cosmetic material 50 without requiring either the entire cover 12 or base 14 to be transparent. This embodiment may also be used with pan 70, which includes a transparent portion that is disposed over or proximate the over-molded transparent segment 80 that forms the viewing area 18.

Figure 13:
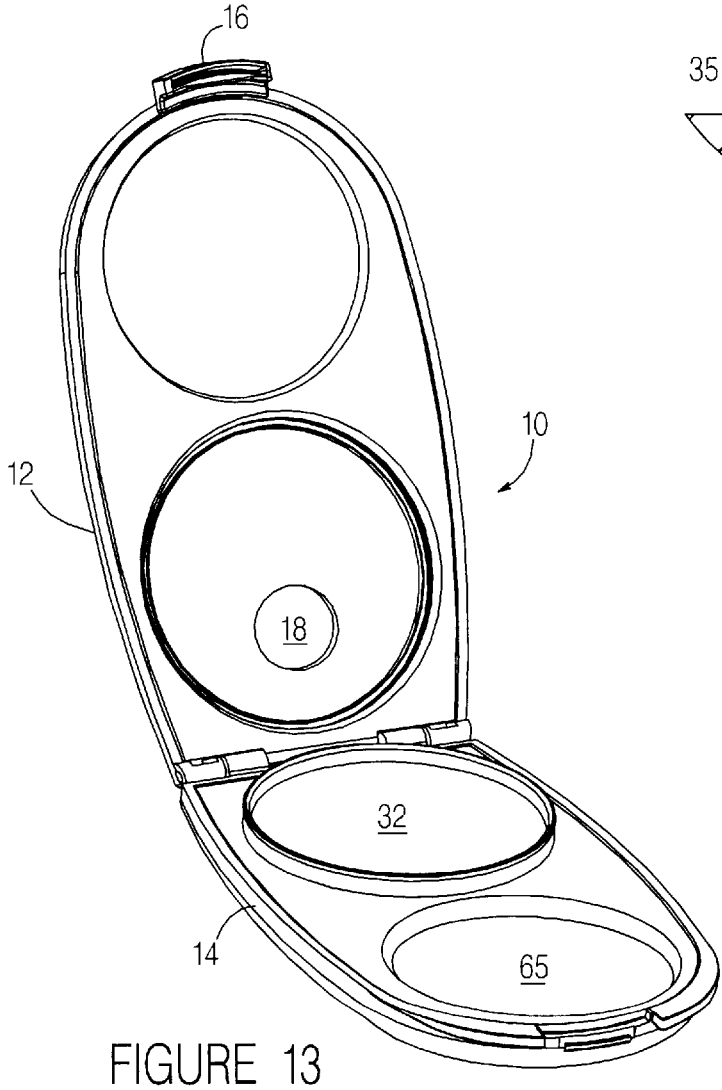
FIG. 13 is a perspective view of an alternative embodiment of a container having a plurality of cavities in an open-position in accordance with the teachings of the present invention.
Figure 11:
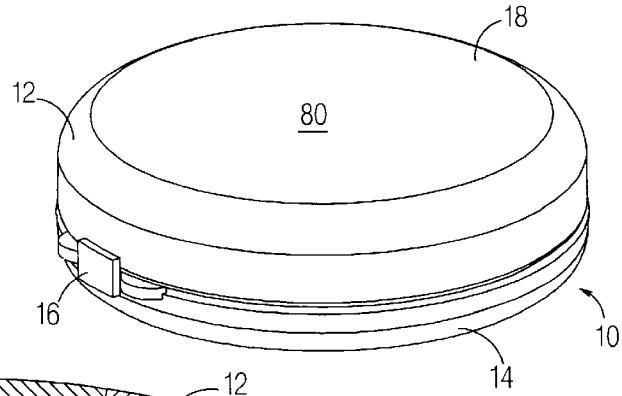
FIG. 11 is a perspective view of a container in a closed-position with a viewing area positioned on a cover of the container in accordance with the teachings of the present invention.
Figure 12:
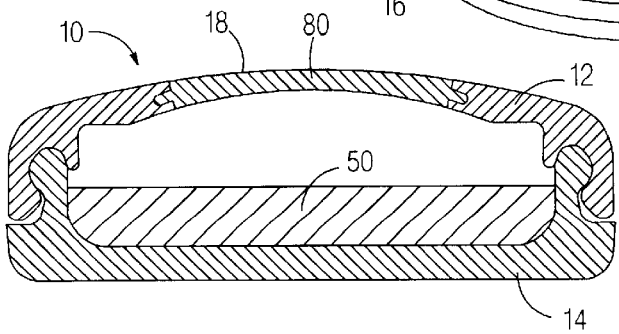
FIG. 12 is a cross-sectional view of the container of FIG. 11.

FIGS. 11 and 12 show an alternative embodiment of container 10 with viewing area 18 provided in cover 12. Viewing area 18 is provided therein by an over-molded segment 80 as described above. Generally, an applicator 15 (e.g., pad or brush applicator) is disposed within the container 10 between cosmetic material and cover 12 or cover piece 24, and may obstruct viewing the cosmetic material through a viewing area 18. Container 10 should then have a space for supplying applicator 15 so that applicator 15 does not obstruct viewing area 18, inhibiting view of cosmetic material 50. For example, applicator may be offset from viewing area 18 or applicator 15 may be in its own cavity. An example of such a container is provided in FIG. 13, which includes a viewing area 18 in cover 12 for viewing cosmetic material stored within cavity 32. Also provided is a second cavity 65 in base 14 for storing an applicator.

Figure 14:
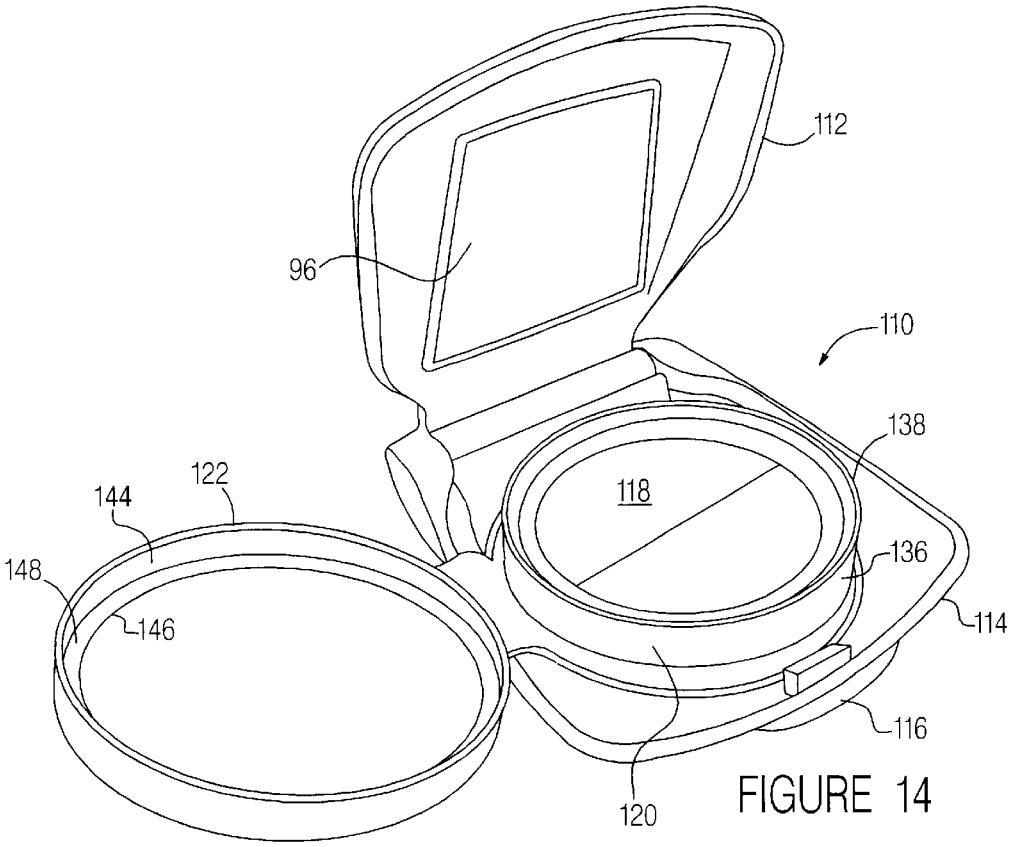
FIG. 14 is a perspective view of an alternative embodiment of a container having a lid in an open-position in accordance with the teachings of the present invention.

FIG. 14 provides an alternative embodiment of an airtight container with viewing area. In this embodiment, container 110 includes a cover 112 and a base 114. Container 110 also includes a cup 120 positioned either integral or fitted within base 114 and a lid 122 fastened or integral with base 114. Lid 122 may be pivotally positioned in either a sealed position, where lid 122 engages cup 120, or an unsealed position where lid 122 is not engaged with cup 120. Cup 120 retains and stores cosmetic material 50. Container 110 may thus be in an open-position, with cover 112 and base 114 separated, while cosmetic material 50 remains in an airtight or substantially airtight compartment when lid 122 and cup 120 are in the sealed position.

Lid 122 interacts with cup 120 in similar fashion as described above to effect the airtight or substantially airtight seal. Cup 120 includes a peripheral rim 136 and lip 138 extending therefrom. Lid 122 includes a peripheral edge 144 and peripheral wall 146 separated by a groove 148 therebetween. When lid 122 is positioned in the sealed position over cup 120, peripheral rim 136 is fitted with groove 148 to effect the hermetic seal in the same manner as described above, similar to that as a film canister lid. Again, lid 122 and cup 120 may be engaged to provide a hermetic seal by other mechanisms known to those skilled in the art. The quality of the hermetic seal may be great enough to inhibit the spoiling, degradation, loss in weight, etc. of the items, which may be stored in container, due to the entry of atmospheric gas, air or other atmospheric conditions (e.g., water, debris, etc.).

Figure 15:
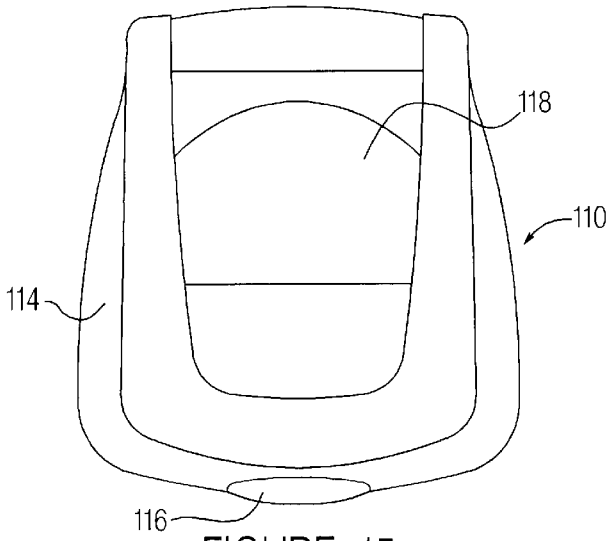
FIG. 15 is a plan view of the container shown in FIG. 14 in the closed-position, illustrating a viewing area.

FIG. 15 shows container 110 with cup 120 and lid 122 in a closed-position. A viewing area 118 is positioned in the base 114 for viewing cosmetic material 50 contained therein. To permit the cosmetic material 50 to be viewed, at least a portion of the cup 120, lid 122, or both should be transparent and aligned with viewing area 118. FIGS. 16–19 show alternative embodiments of airtight container 110, where viewing area 118 is formed by different methods and in different positions, and various embodiments of the lid 122 and cup 120 are also described herein.

Figure 16:
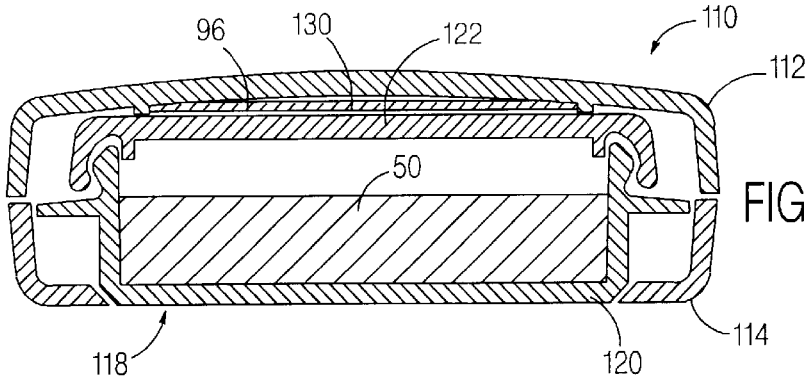
FIG. 16 is a cross-sectional view of the container shown in FIG. 15.

FIG. 16 is a cross sectional view of container 110 in closed-position with cup 120 and lid 122 in the sealed position. Base 114 of container 110 surrounds an aperture which forms viewing area 118. Viewing area 118, however, may be located anywhere on cover 112 or base 114 so long as cosmetic material 50 is visible through the viewing area 118, and may likewise be of any convenient shape. In this embodiment, aperture receives bottom of cup 120, which should be transparent to permit the cosmetic material 50 contained within the cup to be viewed through viewing area 118. Container 110 may also include a mirror 96 retained in cavity 130 of cover 112 for viewing or easier application of the cosmetic material 50 when container 110 is in the open position.

Figure 17:
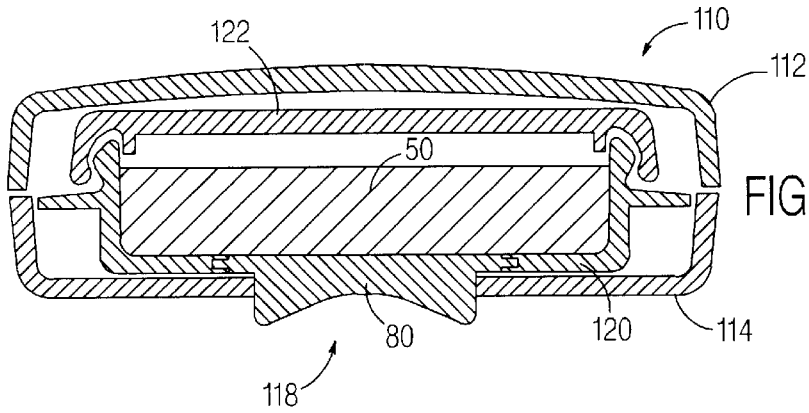
FIG. 17 is a cross-sectional view of an alternative embodiment of a viewing area for a container similar to the container shown in FIG. 15.

FIG. 17 also shows base 114 surrounding an aperture to provide a viewing area 118. In this embodiment, cup 120 includes an over-molded segment 80 within the bottom portion of cup 120. Over-molded segment 80 is transparent and permits cosmetic material 50 contained within cup 120 to be viewed through viewing area 118. In both FIGS. 16 and 17, the entire cup 120 and lid 120 may be transparent or opaque, so long as the area disposed over or proximate to viewing area 118 is transparent to permit viewing cosmetic material 50.

Figure 18:
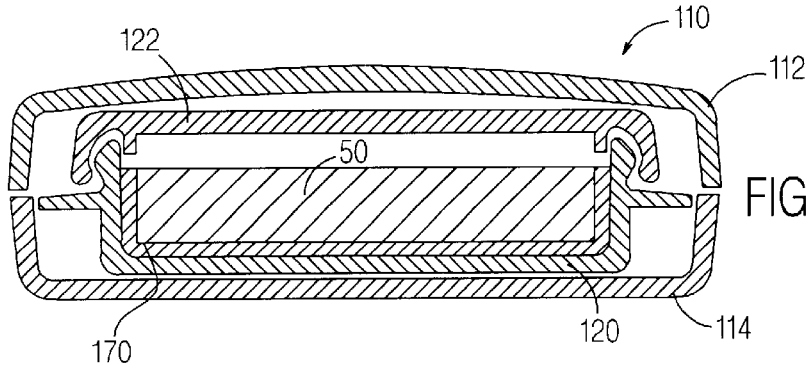
FIG. 18 is a cross-sectional view of an alternative embodiment of a viewing area for a container similar to the container shown in FIG. 15.

FIG. 18 provides an example of container 110 with a viewing area 118 provided by a transparent cover 112. Lid 122 is also transparent to permit the cosmetic material to be viewed when container is in closed-position. The base 114 may either be opaque or clear. Further, cup 120 may also be either opaque or clear. Additionally, cover 112 may only be partially transparent to provide a viewing area to the cosmetic material 50. The cosmetic material may be poured or pressed into a pan 170 which may then be retained within the cup, rather than storing the cosmetic material directly within the cup. Again, this would require the pan to be transparent when the viewing area is positioned on the base for viewing the cosmetic material contained within the pan and cup.

Figure 19:
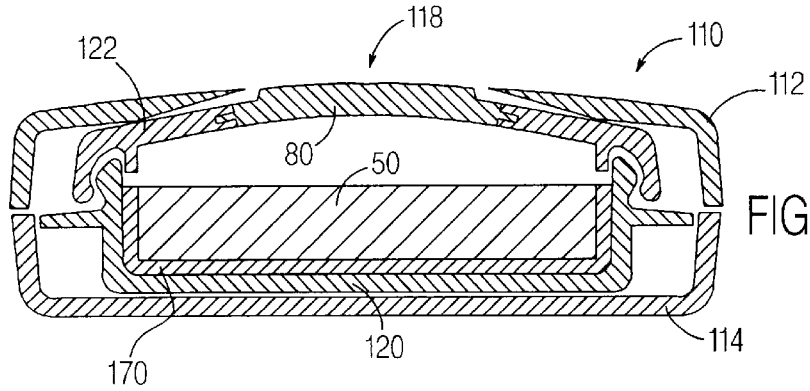
FIG. 19 is a cross-sectional view of an alternative embodiment of a viewing area for a container similar to the container shown in FIG. 15.

FIG. 19 shows an embodiment where cover 112 surrounds an aperture that forms the viewing area 118 in conjunction with lid 122. Lid 122 is convex when in sealed position and includes a transparent over-molded segment 80 that arcs into the aperture surrounded by cover 112 to form viewing area 118. The cosmetic material 50 may then be viewed directly through cover 112.

Figure 20:
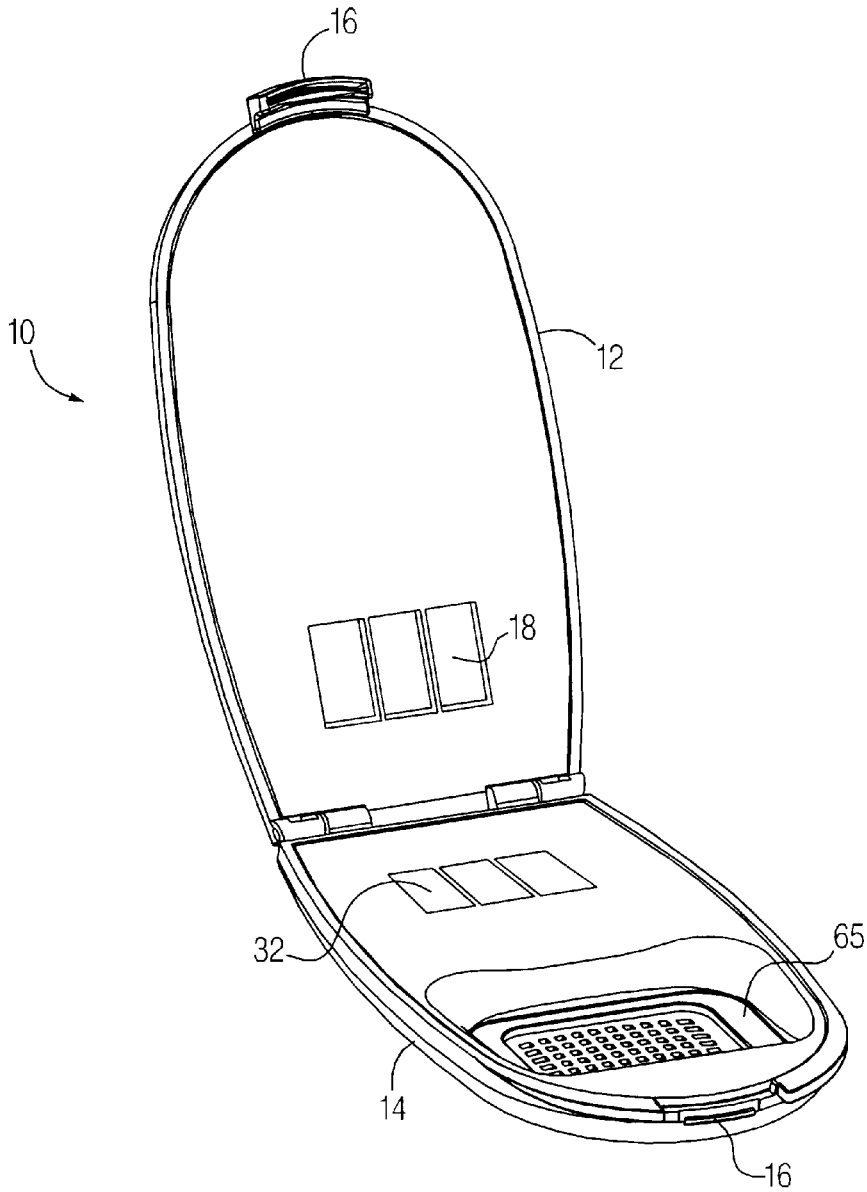
FIG. 20 is a perspective view of an alternative embodiment of a container having a plurality of viewing areas shown in an open-position in accordance with the teachings of the present invention.

In all embodiments, container may include a plurality of viewing areas 18 as shown in FIG. 20. This permits container 10 to include more than one cosmetic material that be viewed separately by each viewing area 18. Further, cosmetic material 50 may be directly filled into at least one cavity 32, cup 120 or pan 70. So long as cosmetic material can be viewed through a viewing area, any desired method of assembly or construction may be performed.

Although only a few embodiments of the present inventions have been described in detail in this disclosure, those skilled in the art who review this disclosure will readily appreciate that any modifications are possible (e.g. variations in sizes, dimensions, structures, shapes and proportions of the various elements, values of parameters, mounting arrangements, use of materials, colors, orientations, protocols, etc.) without materially departing from the novel teachings and advantages of the subject matter recited in the claims. For example, the container may include decorative or functional surface treatments. The hinge assembly may be any type of hinged member (e.g. plate hinge, pin hinge, living hinge, etc.). The vent may include a mechanism to monitor and/or signal when the pressure in the cavities is too high, and may also include a check valve to increase or decrease the pressure in the cavities in response to such signal. The cover plate or the base plate of the insert may be provided with baffles, or may be flexible such that they can withstand a significant increase or decrease of pressure in the cavities. The base may be deformed (e.g., by pushing the center of the base plate towards the cover and lifting an end of the base plate) to reduce the volume within the cavities, thereby evacuating air from the cavities in a "burping" fashion before closing the container. The "footprint" or shape of the container may be rectangular or square, round or oval, hexagonal, or any other shape. Accordingly, all such modifications are intended to be included within the scope of the present invention as defined in the appended claims. The order or sequence of any process or method steps may be varied or re-sequenced according to alternative embodiments. In the claims, any means-plus-function clauses are intended to cover the structures described herein as performing the recited function and not only structural equivalents but also equivalent structures. Other substitutes, modifications, changes and omissions may be made in the design, operating conditions and arrangement of the preferred and other exemplary embodiments without departing from the spirit of the present inventions as expressed in the appended claims.

What is claimed is:

1. A container for storing a cosmetic material comprising:

a cover; and a base coupled to the cover and configured for holding a cosmetic material;

wherein the container is selectively reconfigurable between an open-position and a closed-position; the cover is configured to engage the base to provide an airtight seal when the container is in the closed position; and at least a portion of one of the base and the cover includes at least one viewing area overmolded therein to allow a user to view the cosmetic material.

2. The container of claim 1, wherein the overmolded viewing area comprises at least a portion of the cover and is constructed from a transparent material.

3. The container of claim 1, wherein the overmolded viewing area comprises at least a portion of the base and is constructed from a transparent material.

4. The container of claim 1, wherein the container includes a plurality of overmolded viewing areas provided in at least a portion of one of the base, the cover, and both the base and the cover.

5. The container of claim 1, wherein the container is insertable into a shell and the shell comprises a second viewing area that aligns with the viewing area of the container.

6. The container of claim 5, wherein the shell comprises a latch for maintaining the container in a closed-position.

7. The container of claim 1, wherein the container comprises a plurality of cosmetic materials, each cosmetic material having a color-shade different than the other cosmetic material.

8. The container of claim 7, wherein the cosmetic material may be viewed through at least one viewing area when the container is in the closed-position.

9. A container for storing cosmetic material comprising:

a cover;

a base pivotally coupled to the cover to selectively position the container in either an open-position or closed-position; and at least one pan containing therein a cosmetic material;

wherein the base is configured for holding the pan; the cover and the base are configured to engage one another to provide a substantially airtight seal when the container is in the closed-position; and at least a portion of one of the base, the cover, and base and cover includes at least one viewing area overmolded therein which permits the cosmetic material to be viewed when the container is in closed-position.

10. The container of claim 9, wherein the pan comprises a transparent bottom which is disposed over the overmolded viewing area.

11. A container for storing cosmetic material including a cover and a base coupled to the cover so that the container may be selectively placed in an open position or a closed position, the container comprising:

at least one viewing area overmolded in said container and through which the cosmetic material can be viewed when the container is in a closed position;

means for effecting an airtight seal when the container is in the closed-position;

wherein the cosmetic material is within an airtight compartment provided by the airtight seal when the container is in the closed position.

12. The container of claim 11, wherein the base comprises an overmolded viewing area; and the container comprises a pan having a transparent bottom with a first face closely adjacent the cosmetic material and a second face disposed towards the viewing area.

13. The container of claim 11, wherein the cover comprises a first sealing interface, and the base comprises a second sealing interface, and when the container is in the closed position, the first and the second sealing interfaces engage to provide the airtight compartment between the base and the cover.

14. The container of claim 11, further comprising:

a cup having a transparent portion disposed towards the overmolded viewing area; and a lid coupled to the cup so that the lid may be selectively placed over the cup in one of a sealed position and an unsealed position;

wherein the cup retains the cosmetic material; and the airtight compartment is the void between the lid and the cup when placed in sealed position.

15. The container of claim 14, wherein the cup is integral with the base.

16. The container of claim 14, wherein the cup is snap-fit engaged with the base.

17. A container for storing a cosmetic material comprising:

a shell having a cover and a base pivotally coupled to the cover to selectively position the shell in an open-position or a closed-position;

an insert configured to retain cosmetic material and provide an airtight seal when the shell is in the closed-position; and at least one viewing area is integrally molded with the shell and in a position to permit the cosmetic material to be viewed when the shell is in the closed-position;

wherein the shell is configured to accommodate the insert when in the closed-position.

18. The container of claim 17, wherein the insert configured to retain cosmetic material comprises a cup and a lid pivotally coupled to the base to selectively position the lid in sealed engagement with the cup to provide the airtight seal.

19. The container of claim 18, wherein at least a portion of the cup or the lid disposed over the viewing area is transparent.

20. The container of claim 17, wherein at least a portion of the insert disposed over the viewing area is transparent.

21. The container of claim 17, wherein the insert configured to retain cosmetic material comprises a cover piece; and a base piece; wherein the cover piece is configured to fit within the cover of the shell and the base piece is configured to fit within the base of the shell; and the cover piece and base piece engage to provide an airtight seal when the shell is placed in the closed-position.

22. The container of claim 17, wherein the insert is configured to retain a pan containing cosmetic material therein.

23. The container of claim 22, wherein the pan is retained in the insert with assistance of an adhesive or interference fit.

24. The container of claim 17, wherein the shell surrounding the viewing area is transparent or opaque.

25. A method for storing a cosmetic material comprising:

providing at least one cosmetic material for storage within a container having a first sealing interface; a second sealing interface; and at least one viewing area; and storing the cosmetic material in a substantially airtight compartment;

wherein the container may be selectively positioned in either an open-position or a closed-position; and the first sealing interface engages the second sealing interface to form an airtight seal to provide the substantially airtight compartment containing the cosmetic material; and wherein the viewing area integrally molded within the container and positioned to permit viewing the cosmetic material when the container is in the closed position.

26. The method of claim 25, where in the cosmetic material is provided in a pan for storage within the container.

27. The method of claim 25, wherein the first sealing interface engages the second sealing interface to form the airtight seal when the container is placed in the closed-position.

28. The method of claim 25, wherein the first sealing interface is pivotally coupled with the second sealing interface; and the first sealing interface selectively engages the second sealing interface to form the airtight seal to provide the substantially airtight compartment containing the cosmetic material.

* * * * *